US010406711B2

(12) United States Patent
Iwai et al.

(10) Patent No.: US 10,406,711 B2
(45) Date of Patent: Sep. 10, 2019

(54) KNIFE CYLINDER, ROTARY DIE CUTTER, FIXATION DEVICE FOR KNIFE MOUNTING BASE, AND FIXATION METHOD FOR KNIFE MOUNTING BASE

(71) Applicant: MITSUBISHI HEAVY INDUSTRIES MACHINERY SYSTEMS, LTD., Hyogo (JP)

(72) Inventors: Takanori Iwai, Mihara (JP); Toshiaki Miyakura, Mihara (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 332 days.

(21) Appl. No.: 15/116,213

(22) PCT Filed: Jan. 15, 2015

(86) PCT No.: PCT/JP2015/050867
§ 371 (c)(1),
(2) Date: Aug. 3, 2016

(87) PCT Pub. No.: WO2015/133174
PCT Pub. Date: Sep. 11, 2015

(65) Prior Publication Data

US 2017/0008187 A1 Jan. 12, 2017

(30) Foreign Application Priority Data

Mar. 6, 2014 (JP) ..... 2014-044398

(51) Int. Cl.
*B26D 7/26* (2006.01)
*B26F 1/44* (2006.01)
(Continued)

(52) U.S. Cl.
CPC ..... *B26D 7/2614* (2013.01); *B26F 1/384* (2013.01); *B26F 1/44* (2013.01); *B31B 50/14* (2017.08);
(Continued)

(58) Field of Classification Search
CPC ..... B26D 7/2614; B31B 50/14; B26F 1/384; B26F 1/44; F16B 21/02; F16B 21/04;
(Continued)

(56) References Cited

U.S. PATENT DOCUMENTS

2003/0066405 A1 4/2003 Harrison
2007/0196196 A1* 8/2007 Schorling ..... F16B 21/04 411/555
2012/0325067 A1* 12/2012 Yamada ..... B26F 1/384 83/346

FOREIGN PATENT DOCUMENTS

JP 2001-38692 A 2/2001
JP 2007-136670 A 6/2007
JP 2011-173178 A 9/2011

OTHER PUBLICATIONS

Decision of a Patent Grant in JP Application No. 2014-044398, dated Jan. 17, 2017.
(Continued)

*Primary Examiner* — Kenneth E Peterson
*Assistant Examiner* — Liang Dong
(74) *Attorney, Agent, or Firm* — Hauptman Ham, LLP

(57) ABSTRACT

A knife cylinder is provided with a restraint parts disposed within a fixation hole; a compression coil spring for pressing the restraint parts inwardly of the fixation hole; an operating parts entering the inside of the restraint parts through a mounting hole; a protrusion provided to the restraint parts; a helical groove provided in the operating parts, the helical groove engaging with the protrusion and being configured so that, when the operating parts rotates, the helical groove can
(Continued)

move the restraint parts from a first position to a second position; and a blocking groove provided in the outer surface of the operating parts and blocking the rotation of the operating parts in the reverse direction when the restraint parts is located at the second position.

10 Claims, 9 Drawing Sheets

(51) Int. Cl.

| | |
|---|---|
| ***B26F 1/38*** | (2006.01) |
| ***B31B 50/14*** | (2017.01) |
| *B26D 11/00* | (2006.01) |
| *B31B 100/00* | (2017.01) |
| *B31B 110/35* | (2017.01) |

(52) U.S. Cl.
CPC *B26D 2007/2607* (2013.01); *B26D 2011/005* (2013.01); *B26F 2001/4418* (2013.01); *B26F 2001/4463* (2013.01); *B31B 50/146* (2017.08); *B31B 2100/00* (2017.08); *B31B 2110/35* (2017.08)

(58) Field of Classification Search
CPC ..... F16B 5/10; F16B 21/09; E01C 2201/12; E01C 5/005
USPC ..... 411/394, 411, 419–421, 422, 425
See application file for complete search history.

(56) References Cited

OTHER PUBLICATIONS

International Search Report in PCT/JP2015/050867, dated Mar. 3, 2015.
Written Opinion in International Patent Application No. PCT/JP2015/050867, dated Mar. 3, 2015.

* cited by examiner

KNIFE CYLINDER, ROTARY DIE CUTTER, FIXATION DEVICE FOR KNIFE MOUNTING BASE, AND FIXATION METHOD FOR KNIFE MOUNTING BASE

RELATED APPLICATIONS

The present application is a National Stage of PCT International Application No. PCT/JP2015/050867, filed Jan. 15, 2015 which claims the benefit of priority from Japanese Patent Application No. 2014-044398, filed Mar. 6, 2014.

TECHNICAL FIELD

The present invention relates to a fixation device for a knife mounting base for fixing a fixed object to a predetermined position, a knife cylinder which is used in order to cut a sheet material, a rotary die cutter having the knife cylinder, and a fixation method for a knife mounting base, of fixing the knife mounting base to the knife cylinder.

BACKGROUND ART

A general box making machine is for making a box body (a corrugated box) by processing a sheet material (for example, a corrugated sheet) and is composed of a feeding unit, a printing unit, a die cut unit, and the like. Here, the die cut unit is for forming a creasing line which becomes a fold line or processing a groove which forms a flap, a glue tab for joining, or a hole for a hand hole, with respect to a printed corrugated sheet.

Such a die cut unit has an anvil cylinder and a knife cylinder which are disposed one above the other. The anvil cylinder and the knife cylinder are horizontally disposed, are rotatably supported on a frame at both end portions, and can be rotated in the opposite directions to each other by a drive unit. A knife mounting base is mounted on the outer peripheral surface of the knife cylinder, and a punching is mounted on the knife mounting base. For this reason, when the corrugated sheet is transported between the anvil cylinder and the knife cylinder, for example, hole cutting is performed on the corrugated sheet by the punching knife.

As such a die cut unit (a rotary die cutter), there is, for example, a die cut unit disclosed in PTL 1 below. In PTL 1, a fixing hole which is opened in an outer peripheral surface, an acting force generator disposed in the fixing hole, a sliding parts capable of selectively generating a suction force or a repulsive force with respect to the acting force generator, and a locking member which is configured integrally with the sliding parts and protrudes outward from the outer peripheral surface of a knife cylinder when a repulsive force is generated between the sliding parts and the acting force generator are provided, and a peripheral wall portion of a through-hole perforated in a knife mounting base is fitted between the outer peripheral surface of the knife cylinder and the locking member, whereby the knife mounting base is fixed to the outer peripheral surface of the knife cylinder.

CITATION LIST

Patent Literature

[PTL 1] Japanese Unexamined Patent Application Publication No. 2011-173178

SUMMARY OF INVENTION

Technical Problem

In the past, when mounting a knife mounting base on the outer periphery surface of a knife cylinder, the knife mounting base has been fixed by a large number of bolts. However, at the time of replacement of the knife mounting base, removal and mounting of a large number of bolts are required, and thus a long time is required for the replacement of the knife mounting base. Therefore, in PTL 1, the knife mounting base is fixed to the knife cylinder by the acting force generator disposed in the fixing hole and the sliding parts having the locking member and capable of selectively generating a suction force or a repulsive force with respect to the acting force generator.

Incidentally, in a case of performing hole cutting of the corrugated sheet between the anvil cylinder and the knife cylinder, vibration is generated at the time of the hole cutting of the corrugated sheet by a punching knife. For this reason, in the knife cylinder, it is necessary to secure high reliability in fixing of the knife mounting base such that the knife mounting base does not fall off from the knife cylinder due to the vibration. However, in a case of fixing the knife mounting base to the knife cylinder by using a magnetic force, it is necessary to obtain a strong magnetic force, and this causes an increase in the size and higher cost of the device.

The present invention is for solving the above-described problem and has an object to provide a knife cylinder, a rotary die cutter, a fixation device for a knife mounting base, and a fixation method for a knife mounting base, which enable a reduction in the size and a reduction in the cost of a device.

Solution to Problem

In order to achieve the above object, according to an aspect of the present invention, there is provided a knife cylinder including: a cylinder main body which has a columnar shape and in which a plurality of fixation holes along a radial direction are provided at predetermined intervals in an outer peripheral portion; a knife mounting base to which a knife is fixed and in which a plurality of mounting holes are provided at predetermined intervals; a restraint parts which has a ring shape and is disposed in the fixation hole so as to be movable along a direction of a shaft center and be non-rotatable in a circumferential direction; a biasing member which biases the restraint parts inwardly of the fixation hole; an operating parts in which a locking section which can be locked to the knife mounting base is provided at a base end portion and a tip portion enters the inside of the restraint parts through the mounting hole; an engagement section which is provided at one of an inner surface of the restraint parts and an outer surface of the operating parts; a helical guide section which is provided in the other of the inner surface of the restraint parts and the outer surface of the operating parts, is engaged with the engagement section, and can move the restraint parts from a first position to a second position against a biasing force of the biasing member by rotating the operating parts; and a blocking section which is provided in the other of the inner surface of the restraint parts and the outer surface of the operating parts and blocks rotation of the operating parts in a reverse direction when the restraint parts is located at the second position.

Therefore, first, if the operating parts is rotated by a predetermined angle, the helical guide section moves the restraint parts from the first position to the second position against the biasing force of the biasing member through the engagement section of the restraint parts. Next, if the operating parts is further rotated by a predetermined angle, the engagement section reaches the blocking section, and the engagement section is locked to the blocking section by the biasing force of the biasing member, whereby the rotation of the operating parts in the reverse direction is blocked. Here, the locking section of the operating parts is locked to the knife mounting base, whereby the knife mounting base is fixed to the outer peripheral surface of the cylinder main body. In this case, the operating parts is supported to be biased inwardly of the fixation hole through the restraint parts by the biasing force of the biasing member, and the rotation thereof in the reverse direction is blocked, whereby the operating parts is retained to be prevented from coming out, and therefore, it is possible to rigidly fix the knife mounting base to the outer peripheral surface of the cylinder main body. As a result, it is possible to improve reliability while enabling a reduction in the size and a reduction in the cost of the device.

In the knife cylinder according to the above aspect of the present invention, the guide section has a guide surface having a helical shape, and the blocking section has a blocking surface which is continuous to the guide surface and is bent in a direction opposite to a helical direction of the guide surface.

Therefore, the guide surface having a helical shape moves the restraint parts to the second portion through the engagement section only by rotating the operating parts, and the engagement section is locked to the blocking section, and thus it is possible to easily fix the knife mounting base to the cylinder main body.

In the knife cylinder according to the above aspect of the present invention, a plurality of the engagement sections, a plurality of the guide sections, and a plurality of the blocking sections are provided at predetermined intervals in a circumferential direction of each of the restraint parts and the operating parts.

Therefore, a load to support the knife mounting base on the cylinder main body is taken at positions having predetermined intervals in the circumferential direction in the restraint parts and the operating parts, and thus it is possible to stably fix the knife mounting base to the cylinder main body.

In the knife cylinder according to the above aspect of the present invention, the engagement section is a protrusion which is provided on the inner surface of the restraint parts, the guide section is a helical groove which is provided in the outer surface of the operating parts and engaged with the protrusion, and the blocking section is a blocking groove which is provided to be continuous to the helical groove in the outer surface of the operating parts, and to which the protrusion is locked by the biasing force of the biasing member.

Therefore, the protrusion as the engagement section is provided on the restraint parts side and the helical groove as the guide section and the blocking groove as the blocking section are provided on the operating parts side, whereby a reduction in the size of each of the restraint parts and the operating parts becomes possible, and thus it is possible to reduce the cost.

In the knife cylinder according to the above aspect of the present invention, the helical groove is open at a tip portion of the operating parts and is closed by a stopper which is fixed to the tip portion of the operating parts, in a state where the protrusion is engaged therewith.

Therefore, by fixing the stopper to the tip portion of the operating parts, it is possible to close a tip portion of the helical groove, and it is possible to prevent falling-off of the operating parts from the restraint parts while suppressing an increase in the processing cost of the operating parts.

In the knife cylinder according to the above aspect of the present invention, the biasing member is a compression coil spring, is disposed outside the restraint parts in the fixation hole, and is maintained in a compressed state by coming into contact with a flanged portion of the restraint parts at one end portion and being supported on a fixture which is fixed to an opening portion of the fixation hole, at the other end portion.

Therefore, by making the biasing member the compression coil spring, it is possible to suppress an increase in component cost, and further, it is possible to easily store the compression coil spring in the fixation hole.

In the knife cylinder according to the above aspect of the present invention, in the operating parts, an indication section which indicates a rotated position is provided in the engagement section.

Therefore, it is possible to grasp a fixation position and a release position of the operating parts by the indication section, and thus it is possible to improve safety.

In the knife cylinder according to the above aspect of the present invention, in the operating parts, the locking section can be immersed in the fixation hole by rotating the base end portion without passing through the mounting hole.

Therefore, at the time of non-use, the operating parts is stored in the fixation hole, whereby it is possible to eliminate a protrusion which becomes an obstacle, from the cylinder main body.

Further, according to another aspect of the present invention, there is provided a rotary die cutter including: an anvil cylinder which is supported on a frame so as to be able to be driven and rotated; and the above-described knife cylinder which has a knife fixed to an outer peripheral portion and is supported below the anvil cylinder to face the anvil cylinder in the frame so as to be able to be driven and rotated.

Therefore, it is possible to rigidly fix the knife mounting base to the knife cylinder, and it is possible to improve reliability while enabling a reduction in the size and a reduction in the cost of the device.

Further, according to still another aspect of the present invention, there is provided a fixation device for a knife mounting base including: a restraint parts having a ring shape; an operating parts which has a locking section at a base end portion and in which a tip portion enters the inside of the restraint parts; a biasing member which biases the restraint parts along an entering direction of the operating parts; an engagement section which is provided at one of an inner surface of the restraint parts and an outer surface of the operating parts; a helical guide section which is provided in the other of the inner surface of the restraint parts and the outer surface of the operating parts, is engaged with the engagement section, and can move the restraint parts from a first position to a second position against a biasing force of the biasing member by rotating the operating parts; and a blocking section which is provided in the other of the inner surface of the restraint parts and the outer surface of the operating parts and blocks rotation of the operating parts in a reverse direction when the restraint parts is located at the second position.

Therefore, the operating parts is supported to be biased through the restraint parts by the biasing force of the biasing member, and the rotation thereof in the reverse direction is blocked, whereby the operating parts is retained to be prevented from coming out, and therefore, it is possible to rigidly fix a fixed object, and it is possible to improve reliability while enabling a reduction in the size and a reduction in the cost of the device.

Further, according to still yet another aspect of the present invention, there is provided a fixation method for a knife mounting base, of fixing a knife mounting base provided with a knife and a plurality of mounting holes to an outer peripheral surface of a knife cylinder, in which a restraint parts is disposed in a fixation hole of the knife cylinder so as to be movable along a direction of a shaft center and be non-rotatable in a circumferential direction and is biased inwardly of the fixation hole by a biasing member, and an operating parts which has a locking section which can be locked to the knife mounting base, at a base end portion, and in which a tip portion enters the inside of the restraint parts through the mounting hole, is configured to be disposed in the fixation hole, the fixation method including: a process of making a helical guide section move the restraint parts from a first position to a second position against a biasing force of the biasing member through an engagement section of the restraint parts by rotating the operating parts; and a process of blocking rotation of the operating parts in a reverse direction by the biasing force of the biasing member by locking the engagement section to a blocking section by further rotating the operating parts.

Therefore, the locking section of the operating parts is locked to the knife mounting base, whereby the knife mounting base is fixed to the outer peripheral surface of the cylinder main body. At this time, the operating parts is supported to be biased inwardly of the fixation hole through the restraint parts by the biasing force of the biasing member, and the rotation thereof in the reverse direction is blocked, whereby the operating parts is retained to be prevented from coming out, and therefore, it is possible to rigidly fix the knife mounting base to the outer peripheral surface of the cylinder main body. As a result, it is possible to improve reliability while enabling a reduction in the size and a reduction in the cost of the device.

Advantageous Effects of Invention

According to the knife cylinder, the rotary die cutter, the fixation device for a knife mounting base, and the fixation method for a knife mounting base according to the present invention, the restraint parts, the biasing member, and the operating parts are provided, the engagement section is provided at one of the restraint parts and the operating parts, and the helical guide section and the blocking section are provided in the other of the restraint parts and the operating parts, and therefore, the operating parts is supported to be biased inwardly of the fixation hole through the restraint parts by the biasing force of the biasing member, and the rotation thereof in the reverse direction is blocked, whereby the operating parts is retained to be prevented from coming out. Therefore, it is possible to rigidly fix the knife mounting base to the outer peripheral surface of the cylinder main body, and it is possible to improve reliability while enabling a reduction in the size and a reduction in the cost of the device.

DESCRIPTION OF EMBODIMENTS

Hereinafter, preferred embodiments of a knife cylinder, a rotary die cutter, a fixation device for a knife mounting base, and a fixation method for a knife mounting base according to the present invention will be described in detail with reference to the accompanying drawings. In addition, the present invention is not limited by the embodiments, and in a case where there are a plurality of embodiments, the present invention also includes configurations made by combining the respective embodiments.

Figure 1:
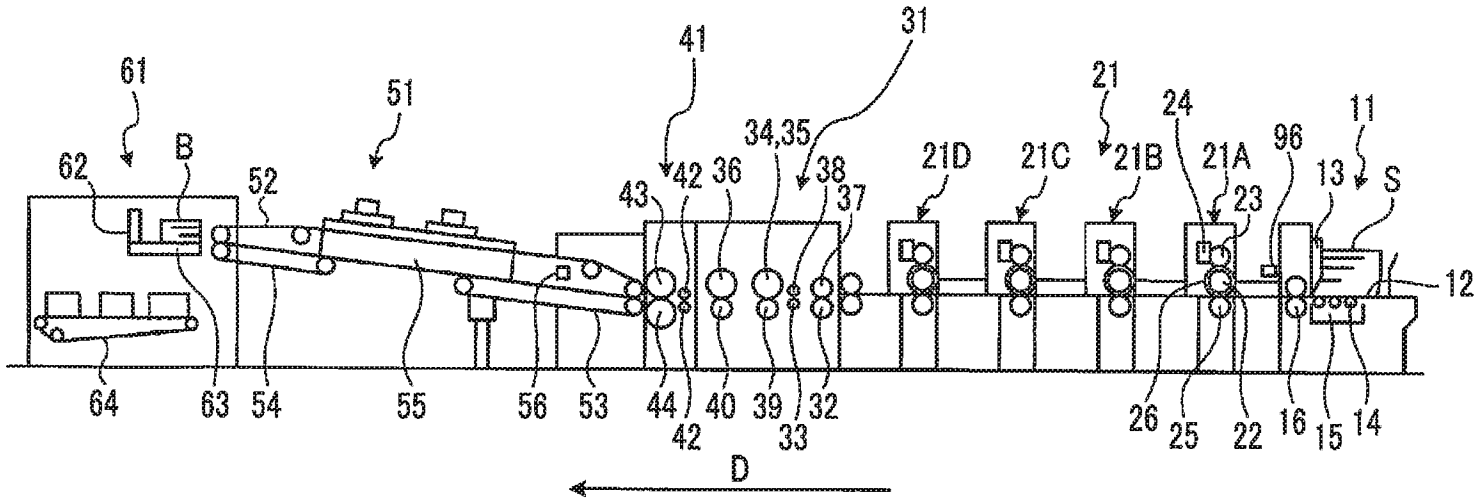
FIG. 1 is a schematic configuration diagram showing a box making machine of this embodiment.

FIG. 1 is a schematic configuration diagram showing a box making machine of this embodiment.

A box making machine of a first embodiment is for making a corrugated box (a box body) B by processing a corrugated sheet (a sheet) S, as shown in FIG. 1. The box making machine is composed of a feeding unit 11, a printing unit 21, a slotter creaser unit 31, a die cut unit 41, a folding unit 51, and a counter ejector unit 61 disposed in a linear arrangement in a direction D of transporting the corrugated sheet S and the corrugated box B.

The feeding unit 11 is for feeding one by one the corrugated sheets S, thereby sending it to the printing unit 21 at a constant speed. The feeding unit 11 has a table 12, a front stop 13, a sheet feeding wheel 14, a suction unit 15, and a feed roll 16. A large number of sheets of corrugated sheets S can be placed to be stacked on the table 12, and the table 12 is supported so as to be able to be moved up and down. The front stop 13 can position the front end portions of the corrugated sheets S stacked on the table 12, and a gap through which one sheet of corrugated sheets S passes is secured between a lower end portion of the front stop 13 and the table 12. A plurality of sheet feeding wheels 14 are disposed to correspond to the table 12 in the transport direction D of the corrugated sheet S and can send forward the corrugated sheet S which is at the lowest position, among a large number of sheets of corrugated sheets S stacked, when the table 12 has been lowered. The suction unit 15 is for suctioning the stacked corrugated sheets S to the lower side, that is, the table 12 side or the sheet feeding wheel 14 side. The feed roll 16 can supply the corrugated sheet S sent by the sheet feeding wheels 14, to the printing unit 21.

The printing unit 21 is for performing polychrome printing (in this embodiment, four-color printing) on the surface of the corrugated sheet S. In the printing unit 21, four print units 21A, 21B, 21C, and 21D are disposed in series and it is possible to perform printing on the surface of the corrugated sheet S by using four ink colors. The print units 21A, 21B, 21C, and 21D have substantially the same configuration and each has a printing cylinder 22, an ink supply roll (an anilox roll) 23, an ink chamber 24, and an impression roll 25. The printing cylinder 22 has a printing die 26 mounted on an outer peripheral portion thereof and is rotatably provided. The ink supply roll 23 is disposed so as to be in contact with the printing die in the vicinity of the printing cylinder 22 and is rotatably provided. The ink chamber 24 is for storing ink and is provided in the vicinity of the ink supply roll 23. The impression roll 25 is for sandwiching the corrugated sheet S between itself and the printing cylinder 22, thereby transporting the corrugated sheet S while applying a predetermined printing pressure thereto, and is rotatably provided below the printing cylinder 22 to face the printing cylinder 22. In addition, although not shown in the drawing, a pair of upper and lower feed rolls is provided in each of the front and rear of each of the print units 21A, 21B, 21C, and 21D.

The slotter creaser unit 31 is for performing creasing line processing and slotting on the corrugated sheet S. The slotter creaser unit 31 has a first creasing roll 32, a second creasing roll 33, a slitter knife 34, a first slotter head 35, and a second slotter head 36.

The first creasing roll 32 is formed in a circular shape, and a plurality of (in this embodiment, four) first creasing rolls 32 are disposed at predetermined intervals in a horizontal direction orthogonal to the transport direction D of the corrugated sheet S and made so as to be able to be rotated by a drive unit (not shown). The second creasing roll 33 is formed in a circular shape, and a plurality of (in this embodiment, four) second creasing rolls 33 are disposed at predetermined intervals in the horizontal direction orthogonal to the transport direction D of the corrugated sheet S and made so as to be able to be rotated by a drive unit (not shown). In this case, the first creasing roll 32 disposed on the lower side is for performing creasing line processing on the rear surface (the lower surface) of the corrugated sheet S, and the second creasing roll 33 disposed on the lower side is for performing creasing line processing on the rear surface (the lower surface) of the corrugated sheet S, similar to the first creasing roll 32, and impression rolls 37 and 38 are provided at upper positions facing the respective creasing rolls 32 and 33 so as to be synchronously rotatable.

Each of the slitter knife 34 and the first slotter head 35 is formed in a circular shape, and a plurality of (in this embodiment, five) slitter knife 34 and a plurality of (in this embodiment, five) first slotter head are disposed at predetermined intervals in the horizontal direction orthogonal to the transport direction D of the corrugated sheet S and made so as to be able to be rotated by a drive unit (not shown). The slitter knife 34 is configured of one piece, is provided to correspond to an end portion in a width direction in the corrugated sheet S which is transported, and can cut the end portion in the width direction in the corrugated sheet S. The first slotter head 35 is configured of four pieces, is provided to correspond to a predetermined position in the width direction in the corrugated sheet S which is transported, and can perform slotting at the predetermined position in the corrugated sheet S. The second slotter head 36 is likewise configured of four pieces, is provided to correspond to a predetermined position in the width direction in the corrugated sheet S which is transported, and can perform slotting at the predetermined position in the corrugated sheet S. In this case, lower slotter knifes 39 and 40 are provided at the facing lower positions of the slitter knife 34 and the first and second slotter heads 35 and 36 so as to be synchronously rotatable.

The die cut unit 41 is for performing hole cutting for a hand hole on the corrugated sheet S. The die cut unit 41 has a pair of upper and lower pull collars 42, an anvil cylinder 43, and a knife cylinder 44. The pull collars 42 are for gripping the corrugated sheet S from above and below and transporting the corrugated sheet S. Each of the anvil cylinder 43 and the knife cylinder 44 is formed in a circular shape and made so as to be synchronously rotatable by a drive unit (not shown). In this case, while the anvil cylinder 43 has an anvil formed at an outer peripheral portion thereof, the knife cylinder 44 has a knife mounting base provided at a predetermined position in an outer peripheral portion thereof.

The folding unit 51 is for forming a flat corrugated sheet box B by folding the corrugated sheet S while transporting it in the transport direction D, and joining both end portions in the width direction. The folding unit 51 has an upper conveyor belt 52, lower conveyor belts 53 and 54, and a forming unit 55. The upper conveyor belt 52 and the lower conveyor belts 53 and 54 are for gripping the corrugated sheet S and the corrugated box B from above and below and transporting them. The forming unit 55 has a pair of right and left forming belts and is for folding each end portion in the width direction in the corrugated sheet S while bending downward each end portion in the width direction in the corrugated sheet S by the forming belts. Further, the folding unit 51 is provided with a gluing unit 56. The gluing unit 56 has a glue gun and can perform gluing at a predetermined position in the corrugated sheet S by discharging glue at a predetermined timing.

The counter ejector unit 61 is for stacking the corrugated boxes B while counting them, and thereafter, discharging the corrugated boxes B after sorting them into a predetermined number of batches. The counter ejector unit 61 has a hopper unit 62. The hopper unit 62 has a liftable elevator 63 on which the corrugated boxes B are stacked, and a front stopper and a corner guard (neither of which is shown) as arranging means are provided at the elevator 63. Further, a discharge conveyor 64 is provided below the hopper unit 62.

Here, an operation of making the corrugated box B from the corrugated sheet S in the box making machine of the first embodiment described above will be described.

In the box making machine of the first embodiment, with respect to the corrugated sheet S, in the feeding unit 11, a large number of sheets of corrugated sheets S stacked on the table 12 are first positioned by the front stop 13, and next, the table 12 is lowered, whereby the corrugated sheet S which is at the lowest position is sent out by the plurality of sheet feeding wheels 14. Then, the corrugated sheet S is supplied to the printing unit 21 at a predetermined constant side by the pair of feed rolls 16.

In the printing unit 21, in each of the print units 21A, 21B, 21C, and 21D, ink is supplied from the ink chamber 24 to the surface of the ink supply roll 23, and if the printing cylinder 22 and the ink supply roll 23 rotate, the ink on the surface of the ink supply roll 23 is transferred to the printing die 26. Then, if the corrugated sheet S is transported between the printing cylinder 22 and the impression roll 25, the corrugated sheet S is gripped by the printing die 26 and the impression roll 25, and printing pressure is applied to the corrugated sheet S, whereby printing is performed on the surface thereof. The printed corrugated sheet S is transported to the slotter creaser unit 31 by pull rolls.

In the slotter creaser unit 31, first, when the corrugated sheet S passes through the first and second creasing rolls 32 and 33, creasing lines are formed in the corrugated sheet S. Next, when the corrugated sheet S with the creasing lines formed therein passes through the slitter knife 34, an end portion in the corrugated sheet S is cut at a cutting position. Then, when the corrugated sheet S passes through the first slotter head 35, grooves are formed at the positions of the creasing lines, and an end portion is cut. Further, when the corrugated sheet S passes through the second slotter head 36, grooves are formed at the positions of the creasing lines, and an end portion is cut, whereby a glue tab is formed. Thereafter, the corrugated sheet S with the grooves and the glue tab formed at the positions of the creasing lines is transported to the die cut unit 41.

In the die cut unit 41, when the corrugated sheet S passes between the anvil cylinder 43 and the knife cylinder 44, a hand hole is formed. Then, the corrugated sheet S with the hand hole formed therein is transported to the folding unit 51.

In the folding unit 51, while the corrugated sheet S is moved in the transport direction D by the upper conveyor belt 52 and the lower conveyor belts 53 and 54, glue is applied to the glue tab by the gluing unit 56, and thereafter, the glue tab is folded down with the creasing line as a base point by the forming unit 55. If the folding proceeds to nearly 180 degrees, a folding force becomes strong, and thus the glue tab and end portion of the corrugated sheet S which overlaps the glue tab are pressed against each other, thereby being brought into close contact with each other, and both end portions of the corrugated sheet S are joined together, whereby the corrugated box B is formed. At this time, in the corrugated box B, two gaps are formed in the joint. Then, the corrugated box B is transported to the counter ejector unit 61.

In the counter ejector unit 61, the corrugated boxes B are sent to the hopper unit 62. The corrugated boxes B sent to the hopper unit 62 are stacked on the elevator 63 in a state where leading end portions in the transport direction D come into contact with the front stopper and the corrugated boxes B are arranged by the corner guard. Then, if a predetermined number of corrugated boxes B are stacked on the elevator 63, the elevator 63 is lowered, and a predetermined number of corrugated boxes B are discharged as one batch by the discharge conveyor 64, thereby being sent to a post-process of the box making machine.

Figure 2:
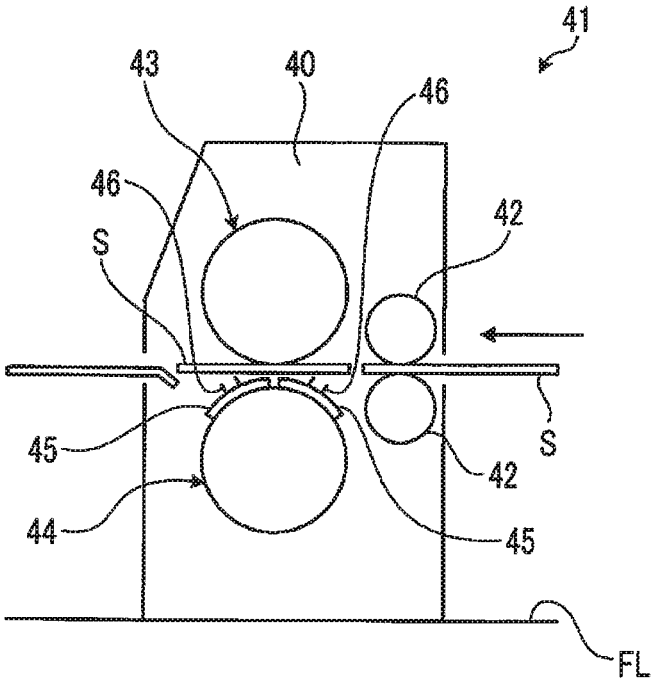
FIG. 2 is a schematic diagram showing a die cut unit of this embodiment.

Here, the die cut unit (a rotary die cutter) 41 of this embodiment will be described in detail. FIG. 2 is a schematic diagram showing the die cut unit of this embodiment, FIG. 3 is a perspective view showing the knife cylinder, and FIG. 4 is a perspective view showing the knife mounting base.

As shown in FIG. 2, in the die cut unit 41, a frame 40 is provided to be erect on a floor surface FL and the anvil cylinder 43 and the knife cylinder 44 are disposed one above the other in the interior of the frame 40. The anvil cylinder 43 and the knife cylinder 44 are disposed so as to be parallel to each other in the horizontal, and are rotatably supported on the frame 40 at the respective end portions, and can be driven and rotated in the opposite directions by a drive unit (not shown). Then, the pair of pull collars 42 is disposed one above the other further toward the upstream side in the transport direction of the corrugated fiberboard S than the anvil cylinder 43 and the knife cylinder 44.

Figure 3:
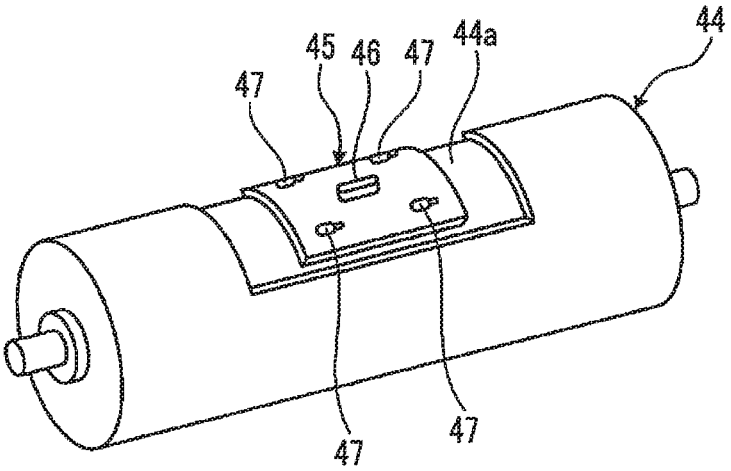
FIG. 3 is a perspective view showing a knife cylinder.
Figure 4:
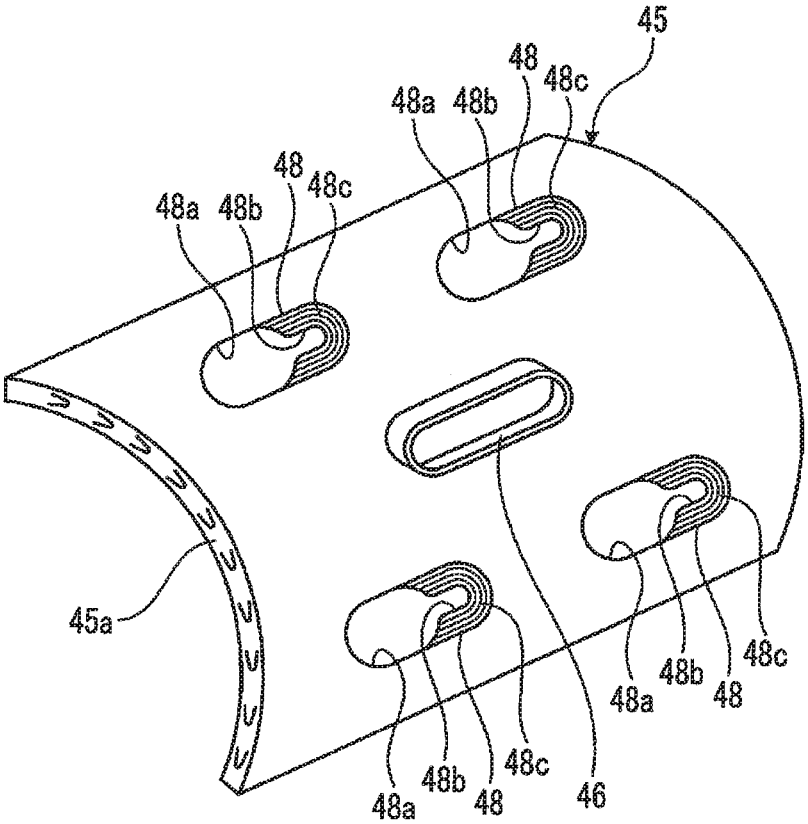
FIG. 4 is a perspective view showing a knife mounting base.

The knife cylinder 44 has a plurality of (or one) knife mounting bases 45 on the outer peripheral surface thereof, as shown in FIGS. 2 and 3. The knife mounting base 45 is provided with a cutting knife (a knife) 46 and is detachably fixed to the outer peripheral surface of a knife cylinder main body 44*a* by a plurality of fixation devices (fixation devices for a knife mounting base) 47. The cutting knife 46 can perform hole cutting on the corrugated sheet S.

The knife mounting base 45 is made of wood and has an arc shape having substantially the same curvature as the knife cylinder main body 44*a* such that the whole surface of an inner peripheral surface 45*a* comes into close contact with the outer peripheral surface of the knife cylinder main body 44*a*. The knife mounting base 45 has the cutting knife 46 fixed to a central portion in the outer peripheral surface thereof. The cutting knife 46 has, for example, a long cylindrical shape and is pressed against the corrugated sheet S, thereby being able to form a hand hole therein. Further, in the knife mounting base 45, a plurality of (in this embodiment, four) mounting holes 48 are formed around the cutting knife 46 in the outer peripheral surface. The mounting hole 48 has a large-diameter portion 48*a* and a small-diameter portion 48*b* which communicate with each other, and the large-diameter portion 48*a* has a vertical wall surface, and the small-diameter portion 48*b* has an inclined surface 48*c* which is enlarged to the outside.

The inner diameter of the large-diameter portion 48*a* is formed to be larger than the outer diameter of a dish section 101 of an operating parts 72 (described later) (refer to FIG. 5) configuring the fixation device 47, and the inner diameter of the small-diameter portion 48*b* is formed to be smaller than the outer diameter of the dish section 101 and larger than a shaft section 102. Then, the large-diameter portion 48*a* and the small-diameter portion 48*b* are disposed along an axial direction of the knife cylinder 44. Further, the inclined surface 48*c* is formed at substantially the same inclination angle as that of an inclined surface of the dish section 101 so as to be able to be properly fitted to the lower surface of the dish section 101 of the operating parts 72. The shape of each of the large-diameter portion 48*a* and the small-diameter portion 48*b* is not limited to a circular shape and may be, for example, an elliptical shape or a square shape.

Further, the knife cylinder 44 (the knife cylinder main body 44*a*) has a columnar shape, and a plurality of fixation holes 49 (refer to FIG. 5) along a radial direction are provided at predetermined intervals (equal intervals) in an outer peripheral portion, and the fixation device 47 is disposed in each of the fixation holes 49. Then, the dimensions of the knife mounting base 45 and the positions of the respective mounting holes 48 are set in accordance with the disposition of each fixation hole 49 and each fixation device 47. That is, when the knife mounting base 45 is fixed to the outer peripheral surface of the knife cylinder main body 44*a*, the mounting hole 48, the fixation hole 49, and the fixation device 47 are made so as to coincide with each other. However, the fixation position of the knife mounting base 45 is adjustable with respect to the knife cylinder main body 44*a*, and therefore, a lot of fixation holes 49 and fixation devices 47 are provided with respect to the mounting hole 48, and the mounting hole 48, the fixation hole 49, and the fixation device 47 coincide with each other at a plurality of different positions.

Figure 5:
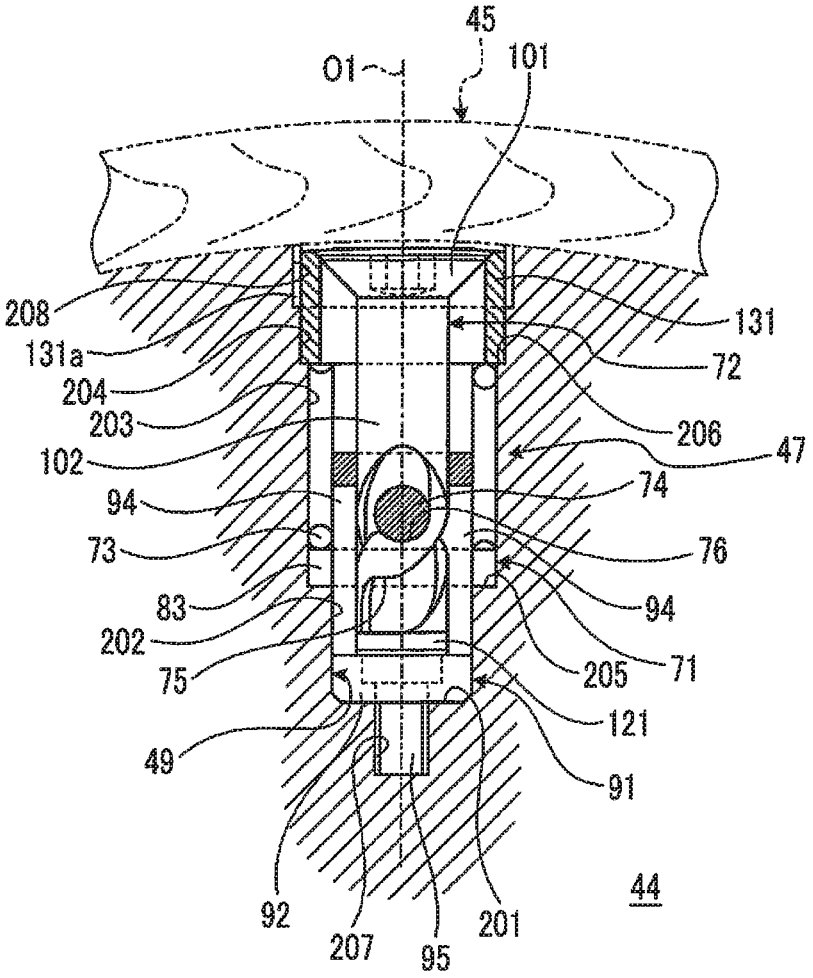
FIG. 5 is a sectional view showing a stored state of a fixation device for a knife mounting base of this embodiment.
Figure 6:
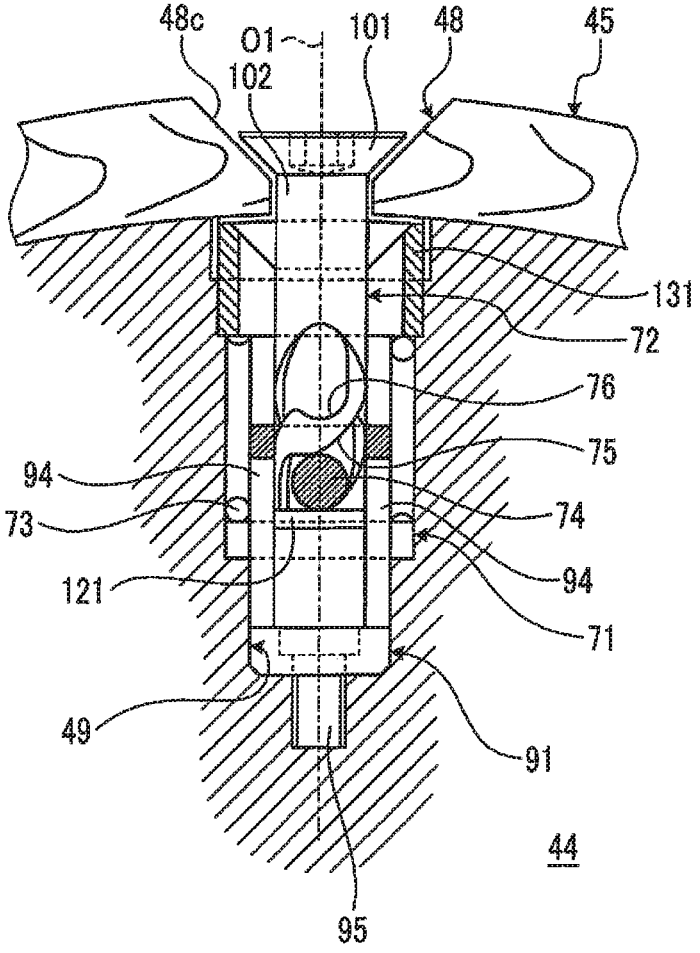
FIG. 6 is a sectional view showing a fixation method for a knife mounting base by the fixation device for a knife mounting base.
Figure 7:
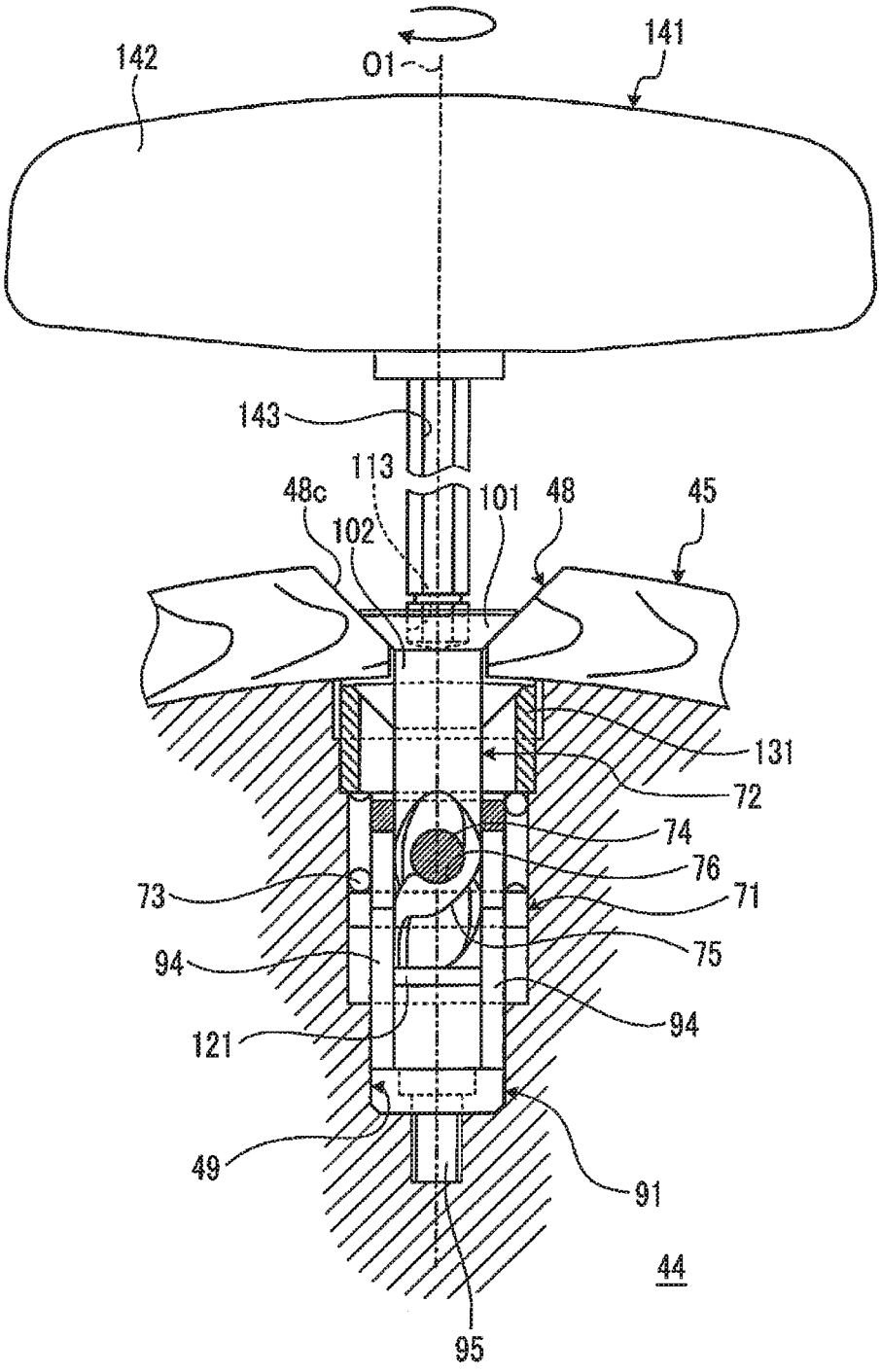
FIG. 7 is a sectional view showing a fixed state of the knife mounting base by the fixation device for a knife mounting base.
Figure 10:
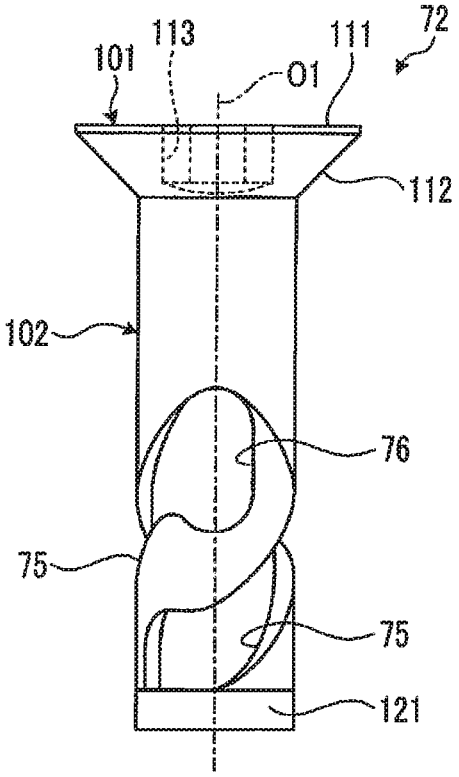
FIG. 10 is a front view of an operating parts.
Figure 11:
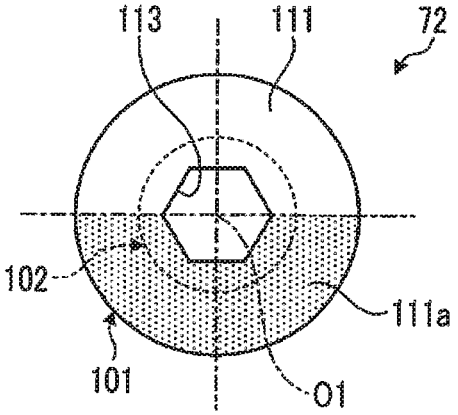
FIG. 11 is a plan view of the operating parts.
Figure 12:
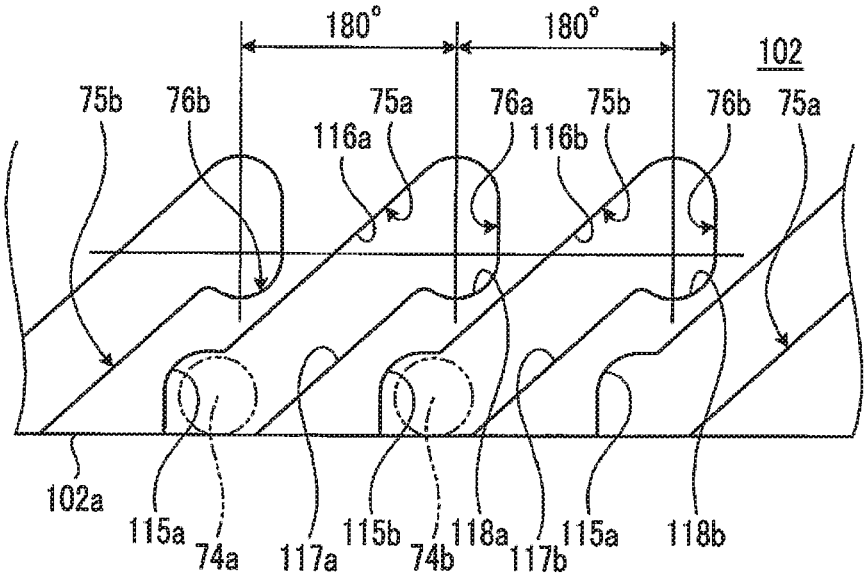
FIG. 12 is a development view of the operating parts showing a helical groove and a blocking groove.

Hereinafter, the fixation device 47 for fixing the knife mounting base 45 to the outer peripheral surface of the knife cylinder 44 will be described. FIG. 5 is a sectional view showing a stored state of the fixation device for a knife mounting base of this embodiment, FIG. 6 is a sectional view showing a fixation method for a knife mounting base by the fixation device for a knife mounting base, FIG. 7 is a sectional view showing a fixed state of the knife mounting base by the fixation device for a knife mounting base, FIG. 8 is a front view of a restraint parts, FIG. 9 is a plan view of the restraint parts, FIG. 10 is a front view of an operating parts, FIG. 11 is a plan view of the operating parts, and FIG. 12 is a development view of the operating parts showing a helical groove and a blocking groove.

The fixation device 47 is disposed in the fixation hole 49, as shown in FIG. 5. The fixation hole 49 is a hole having a columnar shape in which a shaft center O1 is formed along the radial direction of the knife cylinder 44, and is open in the outer peripheral surface of the knife cylinder 44, and a bottom portion 201 is formed on the rotation center side of the knife cylinder 44. The fixation hole 49 is composed of a first hole portion 202, a second hole portion 203, and a third hole portion 204 which are formed from the bottom portion 201 side. In this case, the first hole portion 202, the second hole portion 203, and the third hole portion 204 have inner diameters which are increased in a stepwise fashion in this order, and a first stepped portion 205 is formed between the first hole portion 202 and the second hole portion 203, and a second stepped portion 206 is formed between the second hole portion 203 and the third hole portion 204. Further, in the fixation hole 49, a first female screw portion 207 is formed in the bottom portion 201 and a second female screw portion 208 is formed in the upper inner peripheral surface of the third hole portion 204.

The fixation device 47 has a restraint parts 71, the operating parts 72, and a compression coil spring 73 as a biasing member and has a configuration in which a protrusion 74 as an engagement section is provided at the restraint parts 71 and a helical groove 75 as a guide section and a blocking groove 76 as a blocking section are provided in the operating parts 72.

Figure 8:
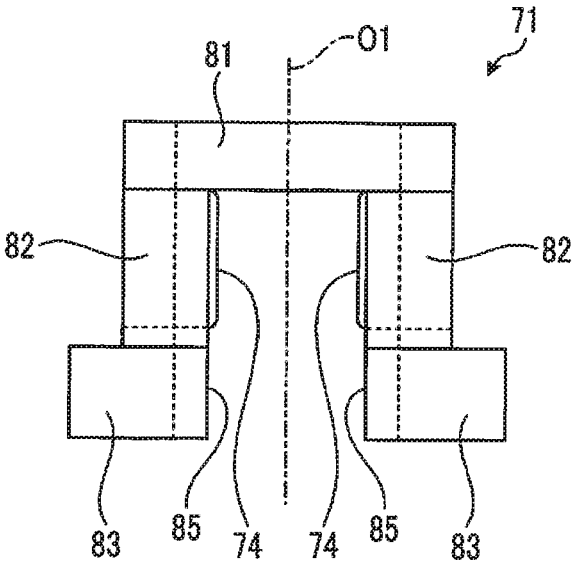
FIG. 8 is a front view of a restraint parts.
Figure 9:
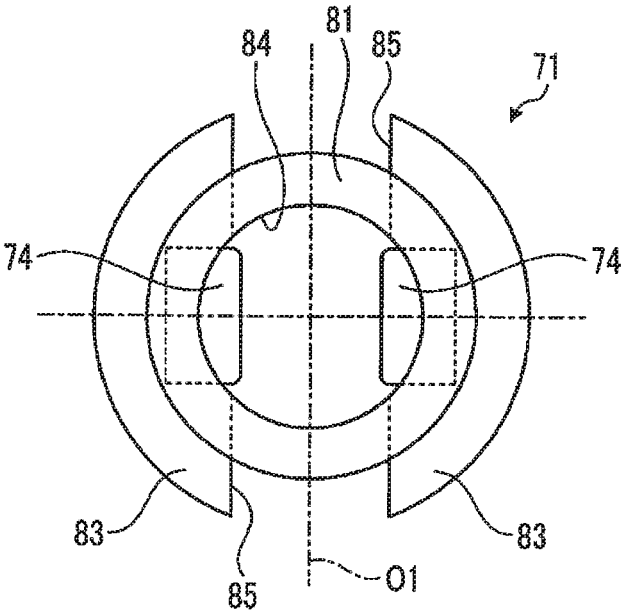
FIG. 9 is a plan view of the restraint parts.

As shown in FIGS. 5, 8, and 9, the restraint parts 71 has a ring shape and is disposed in the fixation hole 49 formed in the knife cylinder 44 so as to be movable along a direction of the shaft center O1 and be non-rotatable in the circumferential direction. The restraint parts 71 has a ring portion 81, right and left wall portions 82, and right and left flanged portions 83. The ring portion 81 has a through-hole 84 formed on the inside, and the right and left wall portions 82 are integrally formed at a lower portion of the ring portion 81. The right and left wall portions 82 has the same arc shape, and the right and left flanged portions 83 are integrally formed at lower portions of the right and left wall portions 82. Each of the flanged portions 83 has an arc shape protruding further toward the outer periphery side than the ring portion 81 and each wall portion 82.

The outer diameter of the restraint parts 71 in the right and left flanged portions 83 is formed to be slightly smaller than the inner diameter of the second hole portion 203, whereby the lower surfaces of the flanged portions 83 are in contact with the first stepped portion 205. Further, in the restraint parts 71, the right and left wall portions 82 and the right and left flanged portions 83 which are located at the lower portion of the ring portion 81 are located at positions shifted by 180 degrees in the circumferential direction, whereby a pair of cutout portions 85 is formed between the right and left flanged portions 83. Further, in the restraint parts 71, the protrusions 74 are respectively provided on the inner surfaces of the right and left wall portions 82. The protrusions 74 have a columnar shape and are provided to extend in a direction approaching each other from the positions shifted by 180 degrees in the circumferential direction of the right and left wall portions 82.

A guide member 91 is fixed to a lower portion of the fixation hole 49. The guide member 91 is composed of a base portion 92 having a cylindrical shape, and a pair of guides 94 integrated with the base portion 92. A fixing bolt 95 passes through the base portion 92 and is screwed to the first female screw portion 207 formed in the bottom portion 201, whereby the guide member 91 is fixed to the lower portion of the fixation hole 49. The pair of guides 94 extends further toward the upper side than the first stepped portion 205 and is disposed at positions shifted by 180 degrees in the circumferential direction.

The restraint parts 71 is supported so as to be movable along the direction of the shaft center O1 of the fixation hole 49 and be non-rotatable in the circumferential direction due to the guide member 91. That is, the respective flanged portions 83 of the restraint parts 71 are fitted to the second hole portion 203, and the respective cutout portions 85 are respectively fitted to the guides 94. For this reason, the restraint parts 71 is made so as to be able to move up and down due to the guides 94 and be unable to rotate in the circumferential direction due to the guides 94.

As shown in FIGS. 5, 10, and 11, the operating parts has a base end portion which can be locked to the small-diameter portion 48*b* of the mounting hole 48 in the knife mounting base 45, and a tip portion which enters the inside of the restraint parts 71 through the large-diameter portion 48*a* of the mounting hole 48 in the knife mounting base 45. The operating parts 72 has the dish section 101 and the shaft section 102. The dish section 101 has an inverted truncated cone shape and has a flat surface 111 formed at an upper portion thereof, and an inclined surface 112 formed over the entire circumference at a side portion thereof. The dish section 101 has a locking hole (a hexagonal hole) 113 formed in a central portion of the flat surface 111, and an indication section 111*a* formed at a half of the flat surface 111. The indication section 111*a* is formed by scraping off the flat surface 111 by a predetermined thickness and then performing painting, and the indication section 111*a* is continuous to the flat surface 111 without a step.

The shaft section 102 has a columnar shape and is integrally connected to a lower portion of the dish section 101, and the outer diameter thereof is formed to be slightly smaller than the inner diameter of the through-hole 84 of the restraint parts 71. A pair of helical grooves 75 and a pair of blocking grooves 76 are formed in the outer peripheral surface of the shaft section 102. The helical groove 75 is engaged with the protrusion 74 of the restraint parts 71 and moves the restraint parts 71 from a first position to a second position against a biasing force of the compression coil spring 73 by rotating the operating parts 72. Further, the blocking groove 76 is for blocking the rotation of the operating parts 72 in the reverse direction when the restraint parts 71 is located at the second position. The helical groove 75 and the blocking groove 76 are provided to be continuous to each other in the outer surface of the operating parts 72, and the protrusion 74 can move between the helical groove 75 and the blocking groove 76, and the protrusion 74 is locked to the blocking groove 76 by the biasing force of the compression coil spring 73.

The helical grooves 75 and the blocking grooves 76 are formed to be shifted by 180 degrees in the circumferential direction in the outer surface of the operating parts 72. As shown in FIG. 12, in a helical groove 75*a* on one side, one end is open at the tip of a tip 102*a* of the shaft section 102, and an inlet enlarged portion 115*a* is formed, and a protrusion 74*a* on one side can enter the inlet enlarged portion 115*a*. Further, the helical groove 75*a* is inclined toward the base end portion side (the upper side) so as to draw a spiral on the outer peripheral surface of the shaft section 102 and communicates with a blocking groove 76*a* at the other end. The blocking groove 76*a* is bent in a direction opposite to a helical direction of the helical groove 75*a*. That is, the helical groove 75*a* has a pair of guide surfaces 116*a* and 117*a* facing each other to have a helical shape, and the blocking groove 76*a* has a blocking surface 118*a* which is continuous to the pair of guide surfaces 116*a* and 117*a*. At this time, although the respective guide surfaces 116*a* and 117*a* of the helical groove 75*a* are continuous to the blocking surface 118*a* of the blocking groove 76*a*, the blocking surface 118*a* is bent from the guide surface 117*a* to the tip 102*a* side of the shaft section 102.

Further, in a helical groove 75*b* on other side, one end is open at the tip of the tip 102*a* of the shaft section 102, and an inlet enlarged portion 115*b* is formed, and a protrusion 74*b* on the other side can enter the inlet enlarged portion 115*b*. Further, the helical groove 75*b* is inclined toward the base end portion side (the upper side) so as to draw a spiral on the outer peripheral surface of the shaft section 102 and communicates with a blocking groove 76*b* at the other end. The blocking groove 76*b* is bent in a direction opposite to a helical direction of the helical groove 75*b*. That is, the helical groove 75*b* has a pair of guide surfaces 116*b* and 117*b* facing each other to have a helical shape, and the blocking groove 76*b* has a blocking surface 118*b* which is continuous to the pair of guide surfaces 116*b* and 117*b*. At this time, although the respective guide surfaces 116*b* and 117*b* of the helical groove 75*b* are continuous to the blocking surface 118*b* of the blocking groove 76*b*, the blocking surface 118*b* is bent from the guide surface 117*b* to the tip 102*a* side of the shaft section 102.

In this manner, the helical groove 75*a* and the blocking groove 76*a*, and the helical groove 75*b* and the blocking groove 76*b* have the same shape and are formed to be shifted by 180 degrees in the circumferential direction (the right-left direction of FIG. 12) of the shaft section 102.

As shown in FIGS. 5 and 10, a stopper 121 is fixed to a tip portion of the operating parts 72. The helical groove 75 is open at the tip portion of the operating parts 72, and the stopper 121 is fixed to the tip portion of the operating parts 72 in a state where the protrusion is engaged with the helical groove 75, whereby the helical groove 75 is closed. That is, the shaft section 102 of the operating parts 72 is movably fitted into the through-hole 84 of the restraint parts 71 and the protrusion 74 and the helical groove 75 are engaged with each other, whereby the restraint parts 71 and the operating parts 72 are connected to each other.

The compression coil spring 73 is disposed outside the restraint parts 71 in the second hole portion 203 of the fixation hole 49, and a lower end portion (one end portion) thereof is in contact with the flanged portion 83 of the restraint parts 71. A fixture 131 is fixed to an opening portion of the fixation hole 49, whereby the compression coil spring 73 is retained in the fixation hole 49. The fixture 131 is made such that a lower portion can be fitted into the third hole portion 204 and a screw portion 131*a* of an upper portion can be screwed to the second female screw portion 208. For this reason, an upper end portion (the other end portion) of the compression coil spring 73 is supported on the fixture 131 which is fixed to the opening portion of the fixation hole 49, whereby the compression coil spring 73 is maintained in a compressed state.

Further, the fixation device 47 described above is for fixing the knife mounting base 45 to the outer peripheral surface of the knife cylinder 44. However, at the time of non-use, the dish section 101 can be immersed in the fixation hole 49 by rotating the base end portion of the operating parts 72 without passing through the mounting hole 48 of the knife mounting base 45. For this reason, the fixation device 47 which is not used is stored in the fixation hole 49, whereby when the knife mounting base 45 is fixed to the outer peripheral surface of the knife cylinder 44, the fixation device 47 which is not used does not get in the way.

Here, a fixation method for the knife mounting base 45 using the fixation device 47 of this embodiment will be described.

The fixation method for a knife mounting base of this embodiment is a method of fixing the knife mounting base 45 provided with the cutting knife 46 and the plurality of mounting holes 48 to the outer peripheral surface of the knife cylinder 44 and has a process of making the helical groove 75 move the restraint parts 71 from the first position to the second position against the biasing force of the compression coil spring 73 through the protrusion 74 of the restraint parts 71 by rotating the operating parts 72, and a process of blocking the rotation of the operating parts 72 in the reverse direction by the biasing force of the compression coil spring 73 by locking the protrusion 74 to the blocking groove 76 by further rotating the operating parts 72.

Specifically, the fixation device 47 is stored in the fixation hole 49 at the time of non-use, as shown in FIG. 5. In this state, the knife mounting base 45 is positioned on the outer peripheral surface of the knife cylinder 44, and at this time, the large-diameter portion 48*a* of the knife mounting base 45 is made to coincide with the fixation device 47. Here, a worker grips an operating section 142 of a fixing jig 141 (refer to FIG. 7), locks an operating rod 143 to the locking hole 113 of the dish section 101 in the operating parts 72, and rotates the operating parts 72 by 180 degrees in one direction (a counterclockwise direction in FIG. 11). Then, the protrusion 74 of the restraint parts 71 is released from the blocking groove 76 of the operating parts 72, moves to the tip portion side along the helical groove 75 by the biasing force of the compression coil spring 73, and stops in contact with the stopper 121. Then, in the fixation device 47, the operating parts 72 moves upward, and thus the dish section 101 protrudes outward from the knife cylinder 44. At this time, the restraint parts 71 stops at the first position shown in FIG. 6 due to the biasing force of the compression coil spring 73.

In addition, the knife mounting base 45 is positioned on the outer peripheral surface of the knife cylinder 44 in a state where the operating parts 72 is stored. However, the knife mounting base 45 may be positioned on the outer peripheral surface of the knife cylinder 44 after the operating parts 72 protrudes from the knife cylinder 44.

If the dish section 101 of the operating parts 72 protrudes from the knife cylinder 44, as shown in FIG. 6, the knife mounting base 45 is moved in the axial direction of the knife cylinder 44, thereby making the small-diameter portion 48*b* of the knife mounting base 45 coincide with the operating parts 72 and fitting the dish section 101 and the inclined surface 48*c* to each other. In this state, a worker grips the operating section 142 of the fixing jig 141, locks the operating rod 143 to the locking hole 113 of the dish section 101 in the operating parts 72, and rotates the operating parts 72 by 180 degrees in the other direction (a clockwise direction in FIG. 11). Then, as shown in FIG. 7, the protrusion 74 of the restraint parts 71 moves along the helical groove 75 of the operating parts 72, whereby the restraint parts 71 moves upward against the biasing force of the compression coil spring 73. Then, the protrusion 74 moves from the helical groove 75 to the blocking groove 76 and stops there. At this time, the restraint parts 71 stops at the second position shown in FIG. 7, at which it has moves upward against the biasing force of the compression coil spring 73.

Here, a worker withdraws the fixing jig 141 from the operating parts 72. Then, the compression coil spring 73 biases the restraint parts 71 inwardly of the fixation hole 49 in a compressed state, and therefore, the protrusion 74 draws the operating parts 72 inwardly of the fixation hole 49 through the blocking groove 76. For this reason, the dish section 101 of the operating parts 72 is locked to the inclined surface 48*c* of the knife mounting base 45, whereby the knife mounting base 45 is fixed to the outer peripheral surface of the knife cylinder 44.

Further, the knife mounting base 45 has the four mounting holes 48, and therefore, the same work as described above is performed by the fixation device 47 at the position of each of the mounting holes 48, thereby fixing the knife mounting base 45 to the outer peripheral surface of the knife cylinder 44.

When removing the knife mounting base 45 from the knife cylinder 44, it is favorable if the reverse procedure to the above-described procedure is performed. That is, a worker rotates the operating parts 72 by 180 degrees in one direction (the counterclockwise direction in FIG. 11) by the fixing jig 141. Then, the protrusion 74 of the restraint parts 71 is released from the blocking groove 76 of the operating parts 72, moves to the tip portion side along the helical groove 75 by the biasing force of the compression coil spring 73, and stop in contact with the stopper 121. Then, in the fixation device 47, the operating parts 72 moves upward, whereby fixing of the knife mounting base 45 by the dish section 101 is released. Here, it is possible to remove the knife mounting base 45 by moving the knife mounting base 45 in the axial direction of the knife cylinder 44 and making the large-diameter portion 48*a* of the knife mounting base 45 coincide with the operating parts 72.

In this manner, the knife cylinder of this embodiment is provided with: the cylinder main body 44*a* which has a columnar shape and in which the plurality of fixation holes 49 along the radial direction are provided at predetermined intervals in the outer peripheral portion; the knife mounting base 45 to which the cutting knife 46 is fixed and in which the plurality of mounting holes 48 are provided at predetermined intervals; the restraint parts 71 which has a ring shape and is disposed in the fixation hole 49 so as to be movable along the direction of the shaft center and be non-rotatable in the circumferential direction; the compression coil spring 73 which biases the restraint parts 71 inwardly of the fixation hole 49; the operating parts 72 in which the dish section 101 which can be locked to the knife mounting base 45 is provided at the base end portion and the tip portion enters the inside of the restraint parts 71 through the mounting hole 48; the protrusion 74 which is provided on the inner surface of the restraint parts 71; the helical groove 75 which is provided in the outer surface of the operating parts 72, is engaged with the protrusion 74, and can move the restraint parts 71 from the first position to the second position against the biasing force of the compression coil spring 73 by rotating the operating parts 72; and the blocking groove 76 which is provided in the outer surface of the operating parts 72 and blocks the rotation of the operating parts 72 in the reverse direction when the restraint parts 71 is located at the second position.

Therefore, first, if the operating parts 72 is rotated by a predetermined angle, the helical groove 75 moves the restraint parts 71 from the first position to the second position against the biasing force of the compression coil spring 73 through the protrusion 74. Next, if the operating parts 72 is further rotated by a predetermined angle, the protrusion 74 reaches the blocking groove 76, and the protrusion 74 is locked to the blocking groove 76 by the biasing force of the compression coil spring 73, whereby the rotation of the operating parts 72 in the reverse direction is blocked. Here, the dish section 101 of the operating parts 72 is locked to the knife mounting base 45, whereby the knife mounting base 45 is fixed to the outer peripheral surface of the cylinder main body 44*a*. In this case, the operating parts 72 is supported to be biased inwardly of the fixation hole 49 through the restraint parts 71 by the biasing force of the compression coil spring 73, and the rotation thereof in the reverse direction is blocked, whereby the operating parts 72 is retained to be prevented from coming out, and therefore, it is possible to rigidly fix the knife mounting base 45 to the outer peripheral surface of the cylinder main body 44*a*. As a result, it is possible to improve reliability while enabling a reduction in the size and a reduction in the cost of the device.

In the knife cylinder of this embodiment, the helical groove 75 is continuous to the blocking groove 76, and the blocking groove 76 is bent in a direction opposite to the helical direction of the helical groove 75. Therefore, the helical groove 75 moves the restraint parts 71 to the second portion through the protrusion 74 only by rotating the operating parts 72, and the protrusion 74 is locked to the blocking groove 76, and thus it is possible to easily fix the knife mounting base 45 to the cylinder main body 44*a*.

In the knife cylinder of this embodiment, the plurality of protrusions 74, the plurality of helical grooves 75, and the plurality of blocking grooves 76 are provided at predetermined intervals (equal intervals) in the circumferential direction of each of the restraint parts 71 and the operating parts 72. Therefore, a load to support the knife mounting base 45 on the cylinder main body 44*a* is taken at evenly spaced positions in the circumferential direction in the restraint parts 71 and the operating parts 72, and thus it is possible to stably fix the knife mounting base 45 to the cylinder main body 44*a*.

In the knife cylinder of this embodiment, the protrusion 74 is provided at the restraint parts 71, and the helical groove 75 and the blocking groove 76 are provided to communicate with each other in the operating parts 72. Therefore, a reduction in the size of each of the restraint parts 71 and the operating parts 72 becomes possible, and thus it is possible to reduce the cost.

In the knife cylinder of this embodiment, the helical groove 75 is open at the tip portion of the operating parts 72 and is closed the stopper 121 which is fixed to the tip portion of the operating parts 72, in a state where the protrusion 74 is engaged therewith. Therefore, by fixing the stopper 121 to the tip portion of the operating parts 72, it is possible to close the tip portion of the helical groove 75, and it is possible to prevent falling-off of the operating parts 72 from the restraint parts 71 while suppressing an increase in the processing cost of the operating parts 72.

In the knife cylinder of this embodiment, the compression coil spring 73 is disposed outside the restraint parts 71 in the fixation hole 49 and is maintained in a compressed state by coming into contact with the flanged portion 83 of the restraint parts 71 at one end portion and being supported on the fixture 131 which is fixed to the opening portion of the fixation hole 49, at the other end portion. Therefore, by using the compression coil spring 73, it is possible to suppress an increase in component cost, and further, it is possible to easily store the compression coil spring 73 in the fixation hole 49.

In the knife cylinder of this embodiment, the indication section 111*a* which indicates a rotated position is provided in the dish section 101 of the operating parts 72. Therefore, it is possible to grasp a fixation position and a release position of the operating parts 72 by the indication section 111*a*, and thus it is possible to improve safety.

In the knife cylinder of this embodiment, the dish section 101 can be immersed in the fixation hole 49 by rotating the base end portion of the operating parts 72 without passing through the mounting hole 48. Therefore, at the time of non-use of the fixation device 47, the operating parts 72 is stored in the fixation hole 49, whereby it is possible to eliminate a protrusion which becomes an obstacle, from the cylinder main body 44*a*.

Further, the rotary die cutter of this embodiment is provided with the anvil cylinder 43 which is supported on the frame 40 so as to be able to be driven and rotated, and the knife cylinder 44 which has the cutting knife 46 fixed to the outer peripheral portion and is supported below the anvil cylinder 43 to face the anvil cylinder 43 in the frame 40 so as to be able to be driven and rotated.

Therefore, the plurality of fixation devices 47 are provided in the knife cylinder 44, whereby it is possible to rigidly fix the knife mounting base 45 to the knife cylinder 44, and it is possible to improve reliability while enabling a reduction in the size and a reduction in the cost of the device.

Further, the fixation device for a knife mounting base of this embodiment is provided with the restraint parts 71, the operating parts 72, and the compression coil spring 73, wherein the protrusion 74 is provided at the restraint parts 71 and the helical groove 75 and the blocking groove 76 are provided in the operating parts 72.

Therefore, the operating parts 72 is supported to be biased through the restraint parts 71 by the biasing force of the compression coil spring 73, and the rotation thereof in the reverse direction is blocked, whereby the operating parts 72 is retained to be prevented from coming out, and therefore, it is possible to rigidly fix the knife mounting base 45, and it is possible to improve reliability while enabling a reduction in the size and a reduction in the cost of the device.

Further, the fixation method for a knife mounting base of this embodiment has a process of making the helical groove 75 move the restraint parts 71 from the first position to the second position against the biasing force of the compression coil spring 73 through the protrusion 74 of the restraint parts 71 by rotating the operating parts 72, and a process of blocking the rotation of the operating parts 72 in the reverse direction by the biasing force of the compression coil spring 73 by locking the protrusion 74 to the blocking groove 76 by further rotating the operating parts 72.

Therefore, the dish section 101 of the operating parts 72 is locked to the knife mounting base 45, whereby the knife mounting base 45 is fixed to the outer peripheral surface of the cylinder main body 44*a*. At this time, the operating parts 72 is supported to be biased inwardly of the fixation hole 49 through the restraint parts 71 by the biasing force of the compression coil spring 73, and the rotation thereof in the reverse direction is blocked, whereby the operating parts 72 is retained to be prevented from coming out, and therefore, it is possible to rigidly fix the knife mounting base 45 to the outer peripheral surface of the cylinder main body 44*a*. As a result, it is possible to improve reliability while enabling a reduction in the size and a reduction in the cost of the device.

Further, in this embodiment described above, the protrusion 74 as an engagement section is provided at the restraint parts 71, and the helical groove 75 as a guide section and the blocking groove 76 as a blocking section are provided in the operating parts 72. However, there is no limitation to this configuration. For example, a configuration is also acceptable in which a helical groove as a guide section and a blocking groove as a blocking section are provided in the restraint parts and a protrusion as an engagement section is provided at the operating parts. Further, a configuration is also acceptable in which a groove portion as an engagement section is provided in the restraint parts and a helical protrusion as a guide section and a blocking protrusion as a blocking section are provided at the operating parts.

Further, in each embodiment described above, the box making machine is composed of the feeding unit 11, the printing unit 21, the slotter creaser unit 31, the die cut unit 41, the folding unit 51, and the counter ejector unit 61. However, there is no limitation to this configuration, and a drying unit, a defective product removing unit, or the like may be further provided. Further, the folding unit or the counter ejector unit may not be provided.

REFERENCE SIGNS LIST

11: feeding unit
21: printing unit
31: slotter creaser unit
41: die cut unit (rotary die cutter)
43: anvil cylinder
44: knife cylinder
45: knife mounting base (fixed object)
46: cutting knife (knife)
47: fixation device
48: mounting hole
48*a*: large-diameter portion
48*b*: small-diameter portion
49: fixation hole
51: folding unit
61: counter ejector unit
71: restraint parts
72: operating parts
73: compression coil spring (biasing member)
74: protrusion (engagement section)
75: helical groove (guide section)
76: blocking groove (blocking section)
91: guide member
101: dish section (locking section)
121: stopper
131: fixture

The invention claimed is:

1. A knife cylinder comprising:

a cylinder main body which has a columnar shape and in which a plurality of fixation holes along a radial direction is provided at predetermined intervals in an outer peripheral portion;

a knife mounting base to which a knife is fixed and in which a plurality of mounting holes is provided at predetermined intervals;

a restraint part which has a ring shape and is disposed in a fixation hole of the plurality of fixation holes so as to be movable along a direction of a shaft center and be non-rotatable in a circumferential direction;

a biasing member which biases the restraint part inwardly of the fixation hole;

an operating part in which a locking section which is configured to be locked to the knife mounting base is provided at a base end portion and a tip portion enters an inside of the restraint part through a mounting hole of the plurality of mounting holes;

an engagement section which is provided at one of an inner surface of the restraint part and an outer surface of the operating part;

a helical guide section which is provided in the other of the inner surface of the restraint part and the outer surface of the operating part, is engaged with the engagement section, and is configured to move the restraint part from a first position to a second position against a biasing force of the biasing member by rotating the operating part; and a blocking section which is provided in the other of the inner surface of the restraint part and the outer surface of the operating part and blocks a rotation of the operating part in a reverse direction when the restraint part is located at the second position, wherein the engagement section is a protrusion which is provided on the inner surface of the restraint part, the guide section is a helical groove which is provided in the outer surface of the operating part and engaged with the protrusion, the helical groove is open at the tip portion of the operating part and the protrusion is provided in the helical groove, and a stopper is fixed to the tip portion of the operating part, wherein the stopper closes an opened area of the helical groove at the tip portion of the operating part to prevent the protrusion from coming out from the helical groove.

2. The knife cylinder according to claim 1, wherein the guide section has a guide surface having a helical shape, and the blocking section has a blocking surface which is continuous to the guide surface and is bent in a direction opposite to a helical direction of the guide surface.

3. The knife cylinder according to claim 1, wherein a plurality of the engagement sections, a plurality of the guide sections, and a plurality of the blocking sections are provided at predetermined intervals in a circumferential direction of each of the restraint part and the operating part.

4. The knife cylinder according to claim 1, wherein the blocking section is a blocking groove which is provided to be continuous to the helical groove in the outer surface of the operating part, and to which the protrusion is locked by the biasing force of the biasing member.

5. The knife cylinder according to claim 1, wherein the biasing member is a compression coil spring, is disposed outside the restraint part in the fixation hole, and is maintained in a compressed state by coming into contact with a flanged portion of the restraint part at one end portion and being supported on a fixture which is fixed to an opening portion of the fixation hole, at another end portion.

6. The knife cylinder according to claim 1, wherein in the operating part, an indication section which indicates a rotated position is provided in the engagement section.

7. The knife cylinder according to claim 1, wherein in the operating part, the locking section is configured to be immersed in the fixation hole by rotating the base end portion without passing through the mounting hole.

8. A rotary die cutter comprising:

an anvil cylinder which is supported on a frame configured to be driven and rotated; and the knife cylinder according to claim 1, which has the knife fixed to the outer peripheral portion and is supported below the anvil cylinder to face the anvil cylinder in the frame to be configured to be driven and rotated.

9. A fixation device for a knife mounting base comprising:

a restraint part having a ring shape;

an operating part which has a locking section at a base end portion and in which a tip portion enters an inside of the restraint part;

a biasing member which biases the restraint part along an entering direction of the operating part;

an engagement section which is provided at one of an inner surface of the restraint part and an outer surface of the operating part;

a helical guide section which is provided in the other of the inner surface of the restraint part and the outer surface of the operating part, is engaged with the engagement section, and is configured to move the restraint part from a first position to a second position against a biasing force of the biasing member by rotating the operating part; and a blocking section which is provided in the other of the inner surface of the restraint part and the outer surface of the operating part and blocks a rotation of the operating part in a reverse direction when the restraint part is located at the second position, wherein the engagement section is a protrusion which is provided on the inner surface of the restraint part, the guide section is a helical groove which is provided in the outer surface of the operating part and engaged with the protrusion, the helical groove is open at the tip portion of the operating part and the protrusion is provided in the helical groove, and a stopper is fixed to the tip portion of the operating part, wherein the stopper closes an opened area of the helical groove at the tip portion of the operating part to prevent the protrusion from coming out from the helical groove.

10. A fixation method for a knife mounting base, of fixing the knife mounting base provided with a knife and a plurality of mounting holes to an outer peripheral surface of a knife cylinder, wherein a restraint part is disposed in a fixation hole of the knife cylinder so as to be movable along a direction of a shaft center and be non-rotatable in a circumferential direction and is biased inwardly of the fixation hole by a biasing member, and an operating part which has a locking section which is configured to be locked to the knife mounting base, at a base end portion, and in which a tip portion enters inside of the restraint part through a mounting hole of the plurality of mounting holes, is configured to be disposed in the fixation hole, the fixation method comprising the steps of:

making a helical guide section move the restraint part from a first position to a second position against a biasing force of the biasing member through an engagement section of the restraint part by rotating the operating part; and blocking rotation of the operating part in a reverse direction by the biasing force of the biasing member by locking the engagement section to a blocking section by further rotating the operating part, wherein the engagement section is a protrusion which is provided on the inner surface of the restraint part, the guide section is a helical groove which is provided in the outer surface of the operating part and engaged with the protrusion, the helical groove is open at the tip portion of the operating part and the protrusion is provided in the helical groove, and a stopper is fixed to the tip portion of the operating part, wherein the stopper closes an opened area of the helical groove at the tip portion of the operating part to prevent the protrusion from coming out from the helical groove.

* * * * *